US010889946B1

(12) United States Patent
Mast et al.

(10) Patent No.: US 10,889,946 B1
(45) Date of Patent: Jan. 12, 2021

(54) SYSTEM AND METHOD FOR SYNTHETIC TURF INFILL REMOVAL DEVICE

(71) Applicants: Robert Mast, Brighton, CO (US); Scott Hodges, Arvada, CO (US); Robert Konkel, Arvada, CO (US)

(72) Inventors: Robert Mast, Brighton, CO (US); Scott Hodges, Arvada, CO (US); Robert Konkel, Arvada, CO (US)

( * ) Notice: Subject to any disclaimer, the term of this patent is extended or adjusted under 35 U.S.C. 154(b) by 0 days.

(21) Appl. No.: 16/794,107

(22) Filed: Feb. 18, 2020

(51) Int. Cl.

| | |
|---|---|
| ***E01C 23/06*** | (2006.01) |
| ***B08B 1/00*** | (2006.01) |
| ***B07B 1/42*** | (2006.01) |
| ***B07B 1/46*** | (2006.01) |
| *E01C 13/08* | (2006.01) |

(52) U.S. Cl.
CPC ..... *E01C 23/06* (2013.01); *B07B 1/42* (2013.01); *B07B 1/4609* (2013.01); *B08B 1/001* (2013.01); *E01C 13/08* (2013.01)

(58) Field of Classification Search
CPC ..... B07B 1/42; B07B 1/4609; E01C 13/08; E01C 23/06; B08B 1/001; A01B 1/246; A01G 20/12; A01G 20/18; A01G 20/20; E01B 27/04; E01B 27/105; E01B 2203/015; E01B 2203/10
See application file for complete search history.

(56) References Cited

U.S. PATENT DOCUMENTS

| | | | | |
|---|---|---|---|---|
| 8,464,801 | B2 | 6/2013 | Bearden | |
| 8,771,434 | B2 | 7/2014 | Mitchell | |
| 9,938,104 | B2 | 4/2018 | Motz et al. | |
| 10,086,415 | B2 | 10/2018 | Mashburn et al. | |
| 10,150,398 | B2 | 12/2018 | King | |
| 2002/0029515 | A1* | 3/2002 | Prevost | A63C 19/04 47/1.01 F |
| 2011/0182664 | A1* | 7/2011 | Brodie | E01C 23/098 404/107 |
| 2012/0006930 | A1* | 1/2012 | Mitchell | E01C 13/08 242/539 |
| 2013/0189057 | A1* | 7/2013 | Motz | A01G 20/10 414/345 |
| 2013/0202396 | A1* | 8/2013 | Motz | A01G 20/10 414/502 |

(Continued)

FOREIGN PATENT DOCUMENTS

| | | | |
|---|---|---|---|
| EP | 2796034 | B1 | 10/2015 |

*Primary Examiner* — Charles A Fox
*Assistant Examiner* — Kalyanavenkateshware Kumar
(74) *Attorney, Agent, or Firm* — Christopher Mayle; Thomas E. LaGrandeur; Bold IP, PLLC

(57) ABSTRACT

A system and method for removing rolls of synthetic turf by connecting a strip of synthetic turf to one or more winches powered by batteries or solar cells, the synthetic turf connected to the winches by a series of winch cables and a pull bar having one or more synthetic turf clamps, whereby once connected, the winches retract the winch cables thereby inverting the synthetic turf and moving the pull bar and synthetic turf across a connected comb. The comb has wheels, a frame, and agitating members such that when the synthetic turf is pulled over the comb, the comb causes vibrations in the synthetic turf so that the infill is displaced from the synthetic turf where the infill may then be collected in a receptacle below for transportation and recycling.

19 Claims, 8 Drawing Sheets

(56) References Cited

U.S. PATENT DOCUMENTS

| | | | | |
|---|---|---|---|---|
| 2014/0265011 | A1* | 9/2014 | Mashburn | C08J 11/06 264/176.1 |
| 2014/0305669 | A1* | 10/2014 | Owegeser | E01C 23/121 172/19 |
| 2016/0340139 | A1* | 11/2016 | Motz | A01G 20/18 |
| 2017/0260704 | A1* | 9/2017 | De Geyter | A46B 13/001 |
| 2017/0347522 | A1* | 12/2017 | Bissonnette | A01D 34/37 |
| 2020/0121816 | A1* | 4/2020 | Grossman | A01G 20/30 |

* cited by examiner

SYSTEM AND METHOD FOR SYNTHETIC TURF INFILL REMOVAL DEVICE

FIELD OF THE DISCLOSURE

This disclosure relates to removing and recycling infill in synthetic turf. More particularly, this invention relates to a system and method for removing and recycling infill in synthetic turf using a portable solar powered device including winches to reposition rolls of synthetic turf and pull the rolls across a comb.

BACKGROUND

Synthetic turf installations in recent years are becoming more and more widespread for indoor and outdoor uses, branching out originally from arenas for sports to now being used in residential lawns and other commercial applications. In a typical convertible installation, synthetic turf is installed to removably cover a support surface where the synthetic turf is repeatedly rolled up and stored after each use so the area underneath can be used for other purposes. In other installations the synthetic turf is used until it is worn out or destroyed.

A problem with synthetic turf is the blades of grass staying upright when pressure has been applied, such as when a person or vehicle is directly on top of the synthetic turf. In natural grass, nutrients such as water are transmitted up from the roots to the grass blades. The nutrients are then stored in vacuoles of the cells in the blades of grass. This process makes the blades of natural grass very resilient such that blades return to their normal position after pressure has been applied. In synthetic turf, this process does not exist, which ends up making the blades of synthetic turf less resilient than natural grass. Some synthetic turf has a durable backing whereby the backing helps the synthetic blades of grass bounce back into their original place and makes the blades more resilient.

However durable backing can only do so much, thus a commonly used technique is to impregnate the synthetic turf with an infill. Additionally, infill helps to shield the backing used on artificial turf from the damage that is caused by UV rays or other environmental elements. There are many types of infill used in synthetic turf, such as silica sand derived from quartz that has been eroded by wind and water. This material is the most cost effective infill and thus is used in several commercial applications. Another infill is rubber, which provides a softer surface and adds volume to artificial turf, making it look fuller and lusher. Depending on the height and density of the synthetic turf, two pounds of infill per square foot or more may be needed. With this amount of weight, the synthetic turf will be hard to lift, manipulate, and move without first removing the infill.

Previous technologies use vacuums to suck up the infill, however vacuums can loosen the fibers in the lawn, which over time will affect the appearance of the lawn. The debris on the lawn that is also sucked up in the process could also damage the vacuum itself, especially if there are larger objects, such as twigs. Other technologies are difficult and require complex machinery. Thus, there is a need for an artificial turf infill removal device that is portable, efficient, and easy to use.

SUMMARY

The disclosure presented herein relates to a system for separating the infill from an area of synthetic turf, a first winch having a first cable, the first cable configured to be extended and retracted from the first winch, a comb frame, the comb frame positioned rearward from the first winch, a pull bar, the pull bar positioned initially rearward from the comb frame, the pull bar configured to move over the comb frame, the pull bar removably connected to the first cable, the pull bar having one or more fasteners removably connected to an end of the area of synthetic turf, wherein the comb frame has one or more agitating members configured to separate the infill from the area of synthetic turf when the first cable is retracted forward to the winch and the area of synthetic turf is pulled over the comb frame in an inverted position, the pull bar having a first wheel and a second wheel, the first wheel and the second wheel configured to rotate upon retraction of the first cable from the first winch, the first winch having one or more chains removably connected to the first winch, the one or more chains removably connected to a fastener, the fastener configured to couple the one or more chains to a surface to stabilize the first winch during operation, the comb frame mounted on wheels or to a vehicle, wherein the fasteners of the pull bar are one or more clamps, the one or more clamps removably holding the area of synthetic turf clamped between a top clamp component and a bottom clamp component, wherein the position of clamps on the pull bar are adjustable in length for different widths of the area of synthetic turf, the system further comprising a second winch having a second cable configured to be extended and retracted, the pull bar removably connected to the second cable wherein the second cable is configured to retract and pull the area of synthetic turf back over the comb frame to enable bidirectional cleaning of synthetic turf, the first winch having one or more solar collectors, the one or more solar collectors configured to convert solar energy to electric energy, the first winch having a battery configured to receive and store the electric energy, the comb frame having a plurality of leg members on the left and right side of the comb frame making up the support structure of the comb frame for which the pull bar passes over, wherein the plurality of leg members are elongated bars including an inclining first bar, a horizontal second bar, and declining third bar, the first bar connected at a terminal end to a terminal end of the second bar, an opposite terminal end of the second bar connected to a terminal end of the third bar, the comb frame comprised of two or more vertical posts which support the agitating members, the agitating members extending between the vertical posts, the comb frame comprised of two or more horizontal posts extending between the two or more vertical posts, the system further comprising comb fasteners, the comb fasteners configured to receive the agitating members and affix the agitating members to a first and second base member, the system further comprising comb fasteners, the agitating members rest upon vertical members, a portion of the agitating members extending past the vertical members wherein the portion extending past the vertical members is connected to the comb fasteners, the ends of the agitating members folded over onto their self so as to form a loop through which a hook on the comb fasteners pass through, the loops secured by a ring, the loop configured to receive the hook wherein the hook restrains longitudinal movement of the agitating members with respect to the vertical members, the first and the second base frame members having one or more fastening holes formed through the first and the second base frame members, the fastening holes of a certain distance from one another wherein the fastening holes through the first base member align with corresponding holes on the second base member, the system further comprising position-locking pins configured to lock the comb fasteners at a specific position in relation to the first and the second frame members.

The present invention also directed to a method of separating infill from an area of synthetic turf, the method comprising, extending a first cable from a first winch rearward to be moved over a comb frame and to extend rearward therefrom, connecting the first cable to a pull bar, the pull bar positioned rearward from the comb frame, removably placing one or more first fasteners on the pull bar to a first end of the area of synthetic turf, the pull bar having one or more wheels, retracting the first cable from the first winch forward to be pulled over the comb frame, the area of synthetic turf inverting when pulled over the comb frame, separating the infill from the area of synthetic turf by one or more agitating members on the comb frame, extending a first chain from the first winch, the first chain positioned on the rear of the first winch, connecting a fastener to the first chain, the fastener coupling the first chain to a surface to provide stability to the first winch, extending a second cable from a second winch, the second winch positioned on the opposite side of the comb frame, connecting the second cable to the pull bar, removably connecting one or more second fasteners on the pull bar to a second end of the area of synthetic turf, retracting the second cable from the second winch pulling the area of synthetic turf back over the comb frame, and separating the infill from the area of synthetic turf by the one or more agitating members on the comb frame.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

DETAILED DESCRIPTION

Figure 1:
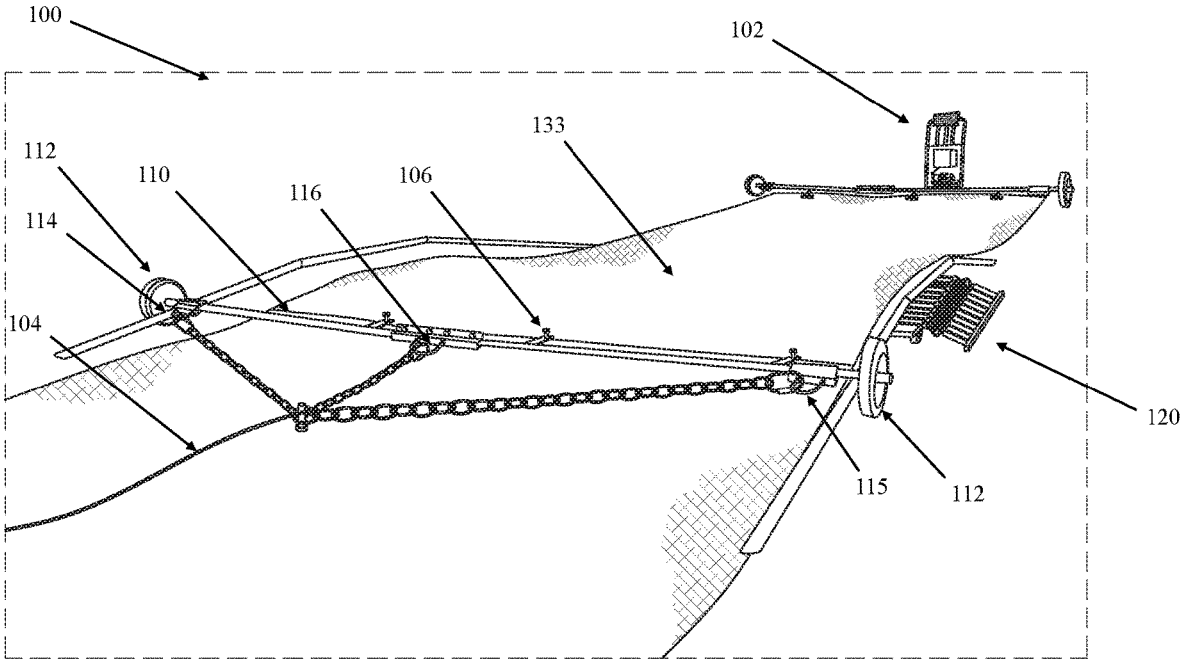
FIG. 1 is an illustration of a top down view of one embodiment of the synthetic turf infill removal device.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and upper limit is the second number. For example, 25 to 100 mm means a range whose lower limit is 25 mm and upper limit is 100 mm.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The present description includes one or more embodiments for a system and method for removing infill from artificial or synthetic turf by connecting an area of synthetic turf to one or more winches powered by batteries or solar cells. The area of synthetic turf may correspond to any type of shape such as a rectangular strip, square, circle, hexagon, octagon, or any other shape known by those of ordinary skill in the art. The area of synthetic turf is connected to the winches by a series of winch cables and synthetic turf clamps. Once connected, the winches retract the winch cables thereby repositioning, inverting, and pulling the synthetic turf across a connected comb. The comb is a structure comprised of pull bars, wheels, a frame, and rails such that when the synthetic turf is pulled over the comb, agitating members on the comb frame causes vibrations in the synthetic turf such that the infill is displaced from the synthetic turf whereby the infill may then be collected in a receptacle below for transportation and recycling.

Once the infill has been removed, the area of synthetic turf may continue to be rolled up whereby the area of synthetic turf may then be disconnected from the winch and transported effortlessly because of the reduction in weight from the displacement of the extra weight from the infill. Elements included herein are meant to be illustrative, rather than restrictive. Persons having ordinary skill in the art relevant to the present disclosure may understand there to be equivalent elements that may be substituted with the present disclosure without changing the essential function or operation of the controller.

Figure 2:
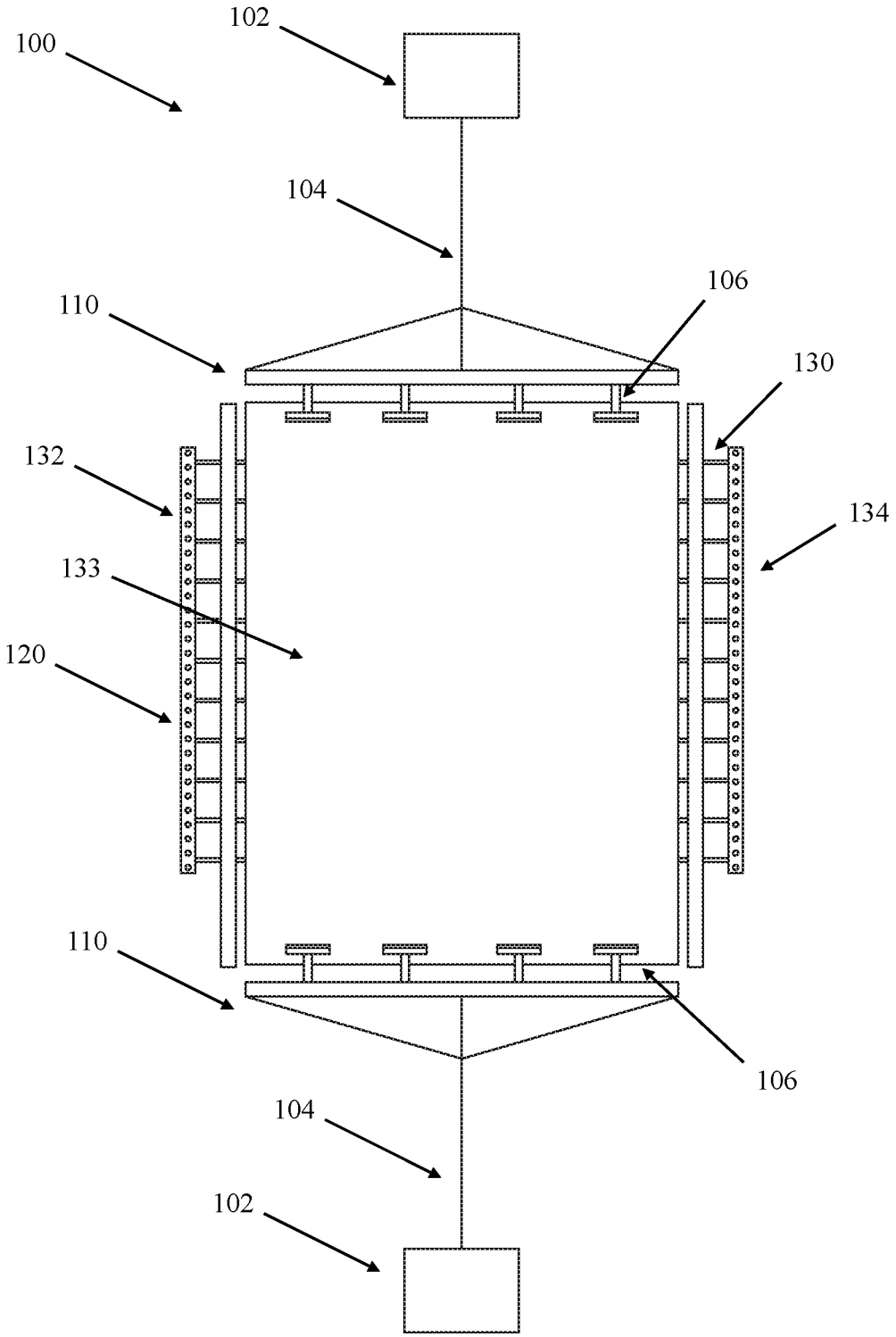
FIG. 2 is an illustration of a perspective top down view of the synthetic turf infill removal device.
Figure 3:
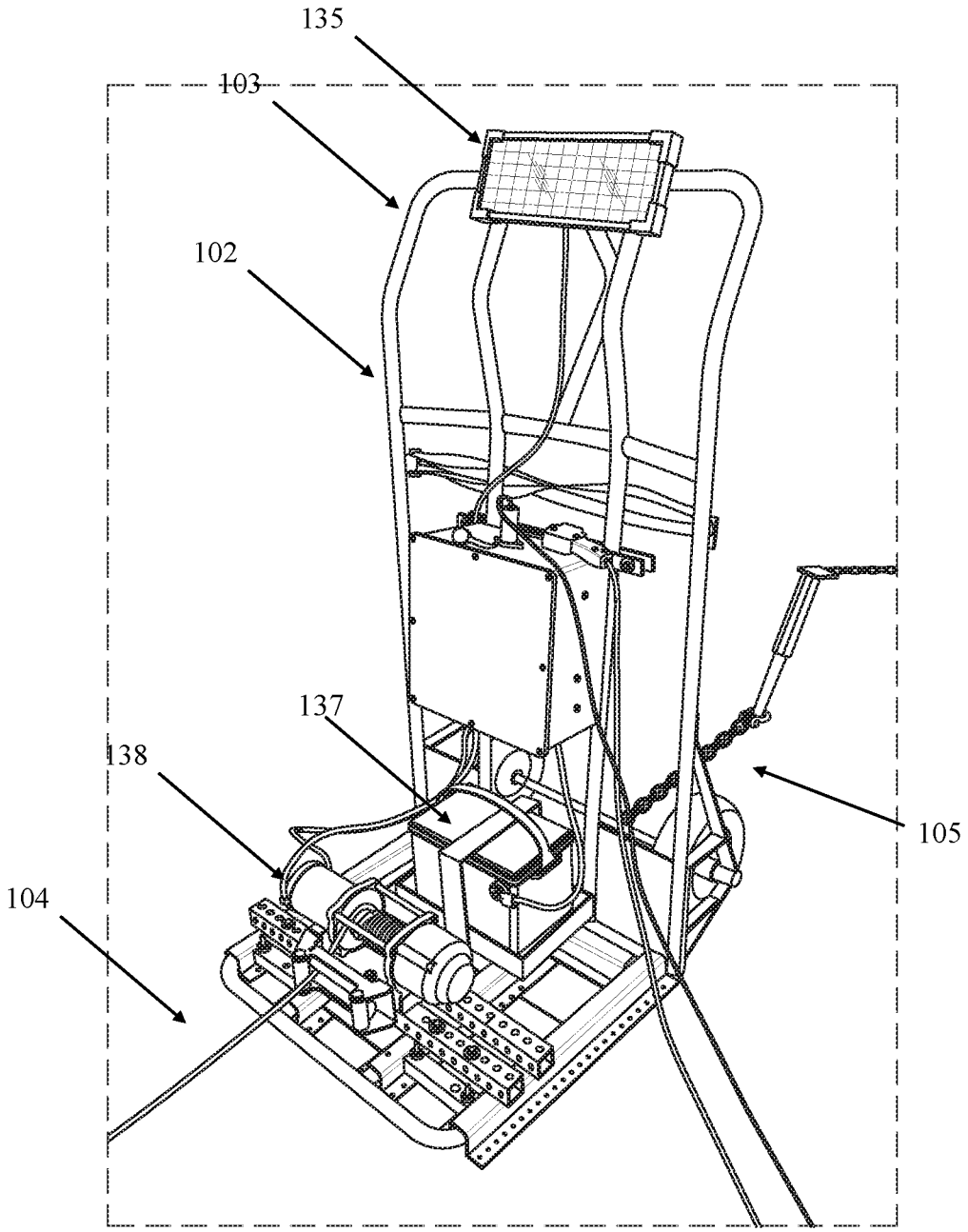
FIG. 3 is an illustration of a front perspective view of the winch of the synthetic turf infill removal device.

Turning to FIG. 1 and FIG. 2, FIG. 1 and FIG. 2 are illustrations of an artificial turf infill removal device 100 according to an embodiment of the present invention. Artificial turf infill removal device 100 may include a first and second winch 102, winch cables 104, pull bar 110, synthetic turf clamps 106, and comb frame 120 used to pull an area of synthetic turf 133. Winch 102, as illustrated in FIG. 3 may be used to reposition the area of synthetic turf 133 and pull the synthetic turf 133 across comb frame 120. Winch 102 may be an electrical winch having a power distribution system capable of being solar charged that may provide power to the various components of winch 102. In one or more non-limiting embodiments, winch 102 may instead include a manually operated crank or a powered device in operative connection with a drum inside winch 102 to control winding of winch cable 104 therearound.

Winch 102 may have a solar energy collector such as solar energy collector 135 for collecting and converting solar energy to electrical energy. The solar generated electrical energy then passes through a first controller for distributing the electrical energy. The electrical energy may be stored in a battery such as battery 137; however, it may be used immediately to create a potential energy difference. Battery 137 may hold an electrical-chemical potential sufficient to power the various components of winch for a predetermined amount of time. Battery 137 may be connected to a microprocessor. The microprocessor may direct current flow to a motor or control system after a preprogrammed or otherwise predetermined amount of time. The control system may include circuitry to provide an actuable interface for the user to interact with, including switches, indicators, and accompanying circuitry for an electronic control panel or mechanical control panel. The interface may present options to the user to select from, such as retracting and extending winch cables.

Winch 102 may be mounted to a dolly 103 with small rollers and a base frame to provide support for winch 102 while facilitating the transportation of winch 102 for a more portable system. Winch 102 is designed to pull in, let out, or otherwise adjust the tension of connected winch cables by a motorized system, including a motor such as motor 138. Winch 102 may include a drum and spool about which the winch cable 104 is windable. Winch cables 104 is described throughout the specification but may correspond to one or more straps, rope, chains, or cables or any other apparatuses that may be used in one or more applications.

Motor 138 used in extracting and retracting winch cables 104 may be attached to the housing of winch 102 by fasteners such as bolts, latches, screws, or any other fasteners well known to those skilled in the art. The motor operates by providing a torque that rotates the spool. Winch cables 104 withdraw from the spool located inside winch 102 when the spool rotates in a counterclockwise direction to play out the outer portion of the length of winch cables 104. As the spool rotates, the spool carries with it the inner turns of winch cables 102 but, as it proceeds to rotate relative to the drum, the innermost turn of the inner portion of the length of winch cables 104 leaves its position and extends outward of winch 102.

Winch chains may be connected to the winch such that winch chains may be used to pull the area of synthetic turf 133 over the comb. Winch cables 104 may be connected to the spool of winch 102 and wrapped around the motor inside of the housing of the winch wherein an outer portion of the length of winch cables 104 may be withdrawn from the spool while permitting the inner end of the length of winch cables 104 to be secured at all times to the spool of winch 102. Winch cables 104 may be made of any metallic material or any flexible cut-resistant material such as a manufactured fiber or any other suitable material.

The end of winch cables 104 protruding outside of winch 102 may have a clamp on the end of winch cables 104. The spool may be rotatably mounted within winch 102 while a drum may be held in a stationary position within winch 102 whereby the spool may be rotated within winch 102 in a clockwise or counterclockwise rotation relative to the drum. The drive member of the motor in contact with the spool may directly reciprocate the spool wherein rotational energy produced by the motor is converted to linear movement of winch cables 104 to extend and retract winch cables 104 from winch 102.

Winch 102 may include a brake that automatically engages the drum when the motor is stopped or there is an area of synthetic turf 133 connected to the winch cables 104. Winch 102 may include a clutch that allows the winch drum to be disengaged from the drive train of the motor to enable the drum to rotate freely. Winch 102 may have a stopping mechanism to prevent winch cable 104 from bending at too great of an angle. Winch 102 may be connected to a chain or cable 105 whereby a stake or other apparatus may be positioned through or otherwise fastened to cable 105 to further stabilize winch 102 and keep winch 102 from lifting off the ground or another surface.

Figure 4:
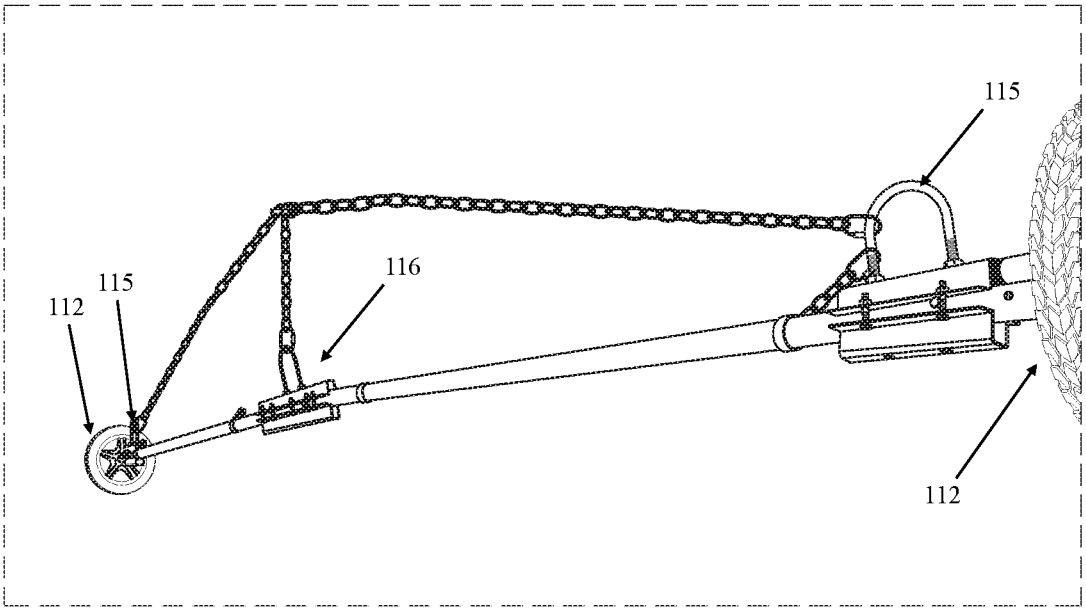
FIG. 4 is an illustration of an end of the pull bar of the synthetic turf infill removal device.

The end of winch cables 104 may be connected to pull bar 110 directly or winch cables 104 may be connected to a series of intermediate cables to connect winch cable to pull bar 110, as illustrated in FIG. 4. Pull bar 110 may have one or more semicircular mounting brackets such as mounting brackets 114, 115, and 116, whereby mounting brackets 114, 115, and 116 extend substantially perpendicular from rear surface of pull bar. Mounting brackets 114 and 115 may equally be separated from a centerline axis of pull bar 110 and have "u" shaped design with the rear surface of pull bar 110. Mounting bracket 116 may be positioned along the centerline axis of pull bar 110. Mounting brackets 114 and 115 have integrally formed receiving holes. Winch cables 104 may be affixed to pull bars 110 whereby winch cables 104 may be wrapped around, passed through, hooked or otherwise securely affixed to mounting brackets 114, 115, and 116.

Figure 5:
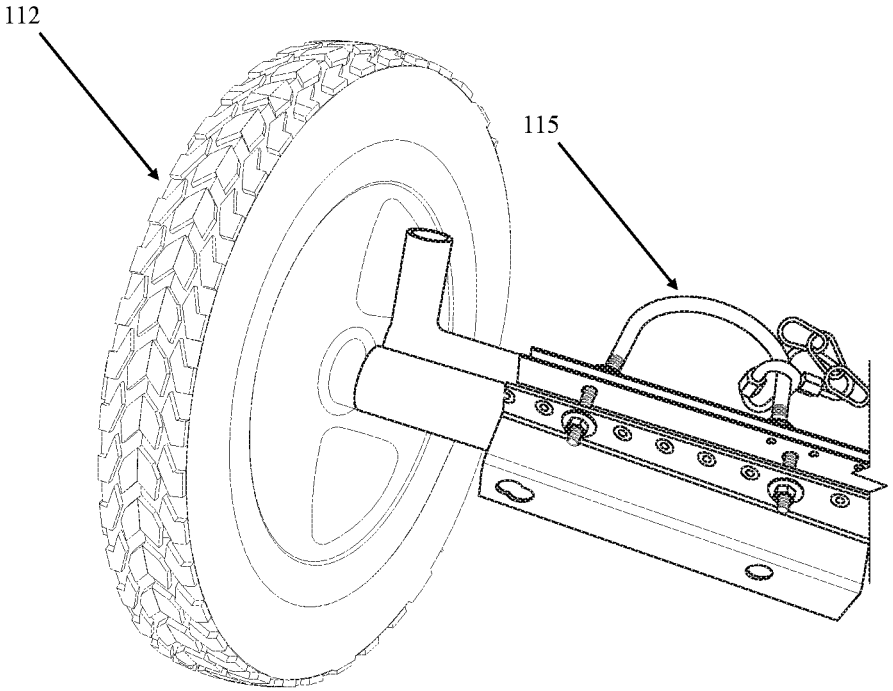
FIG. 5 is an illustration of a side perspective view of the pull bar of the synthetic turf infill removal device.

Pull bar 110 may have two wheels such as wheels 112 positioned at opposing ends, such as the left and right ends, of the longitudinal axis of pull bar 110. An enlarged view of a wheel 112 is illustrated in FIG. 5. In the description, the terms "left," "right," "upper," "lower," "front," and "back" as referred to in the figures is anecdotal, pertaining to the relationship of features or to the arrangement of elements so as to provide a reference point(s) for the reader. Wheels 112 are designed to roll across a surface to facilitate transportation of pull bar 110 across the surface while providing support and lessening the drag on pull bar 110. Wheels 112 may be rotatably coupled with a set of axles whereby each of the axles are connected to pull bar 110. The positioning of wheels 112 along the sides of pull bar 110 and their attachment to axles connected to pull bar 110 allow for the use of wheels 112 having a larger enough diameter to be guided by comb frame 120, thereby improving stability and ground contact to assist in moving along softer and uneven surfaces and inclined surfaces. Wheels 112 may have a wheel stopping mechanism (not shown) to stop the rotation of wheels 112 connected to wheels 112 themselves or another part of pull bar 110.

Figure 6:
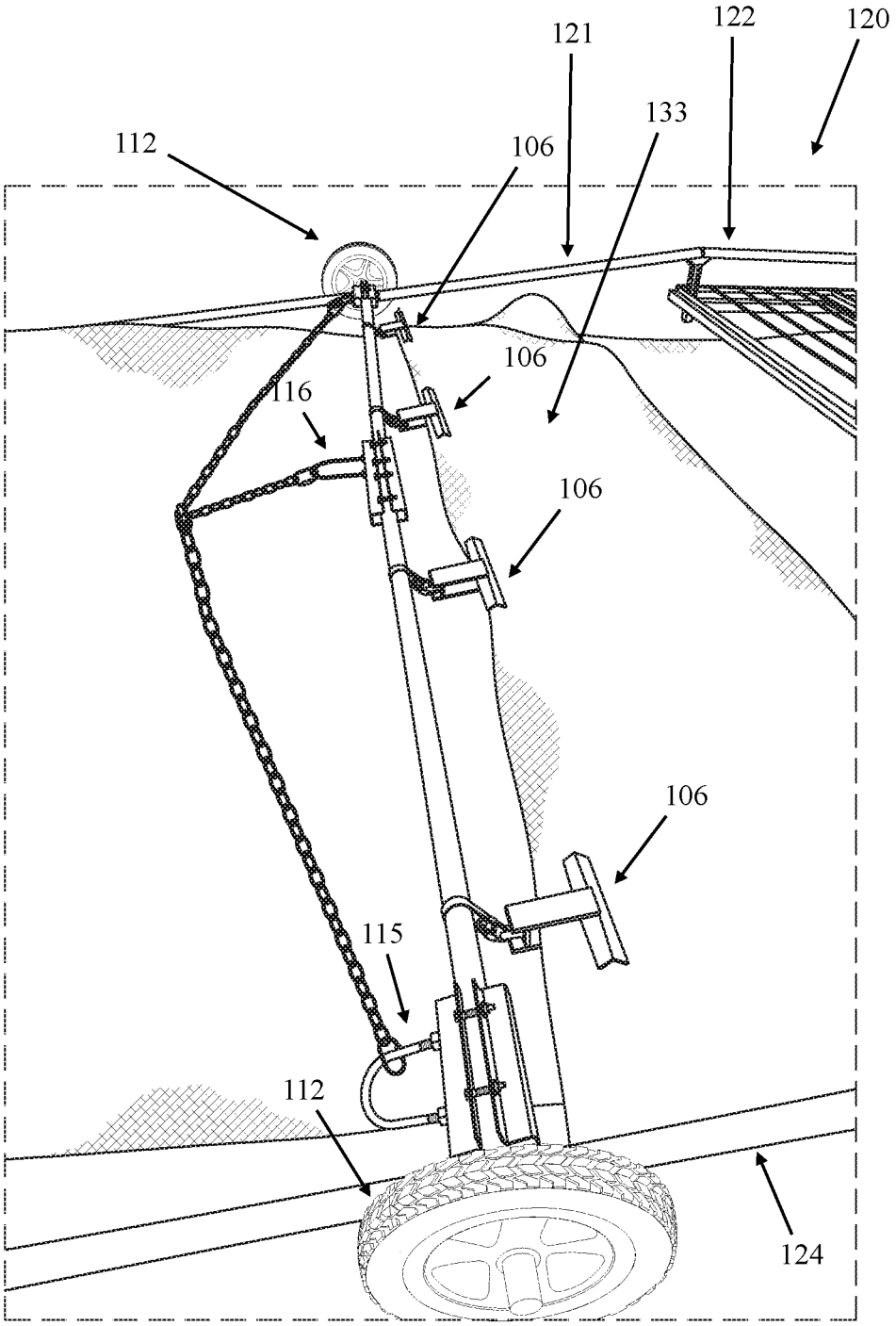
FIG. 6 is an illustration of the pull bar attached to an area of the synthetic turf.

Pull bar 110 may be connected to one or more synthetic turf clamps 106, as illustrated in FIG. 6, used to attach pull bar to the edge of an area of synthetic turf 133. Clamps are designed to securely hold the area of synthetic turf 133 clamped between a top clamp component and a bottom clamp component of clamp 106. The top clamp component and bottom clamp component may be pivotably rotated away from one another and towards one another to engage and disengage the clamp from the area of synthetic turf 133. Clamps 106 may also be integral to pull bar 110 or removably connected by one or more fasteners. Clamps 106 be made of a stainless steel or material such as aluminum, copper, titanium, brass, magnesium, fiberglass, gold, silver, graphite, ceramic, plastic, carbon fiber, wood, polymers, and other composites that provide suitable durability and corrosion resistance to protect from the outside elements.

Figure 7:
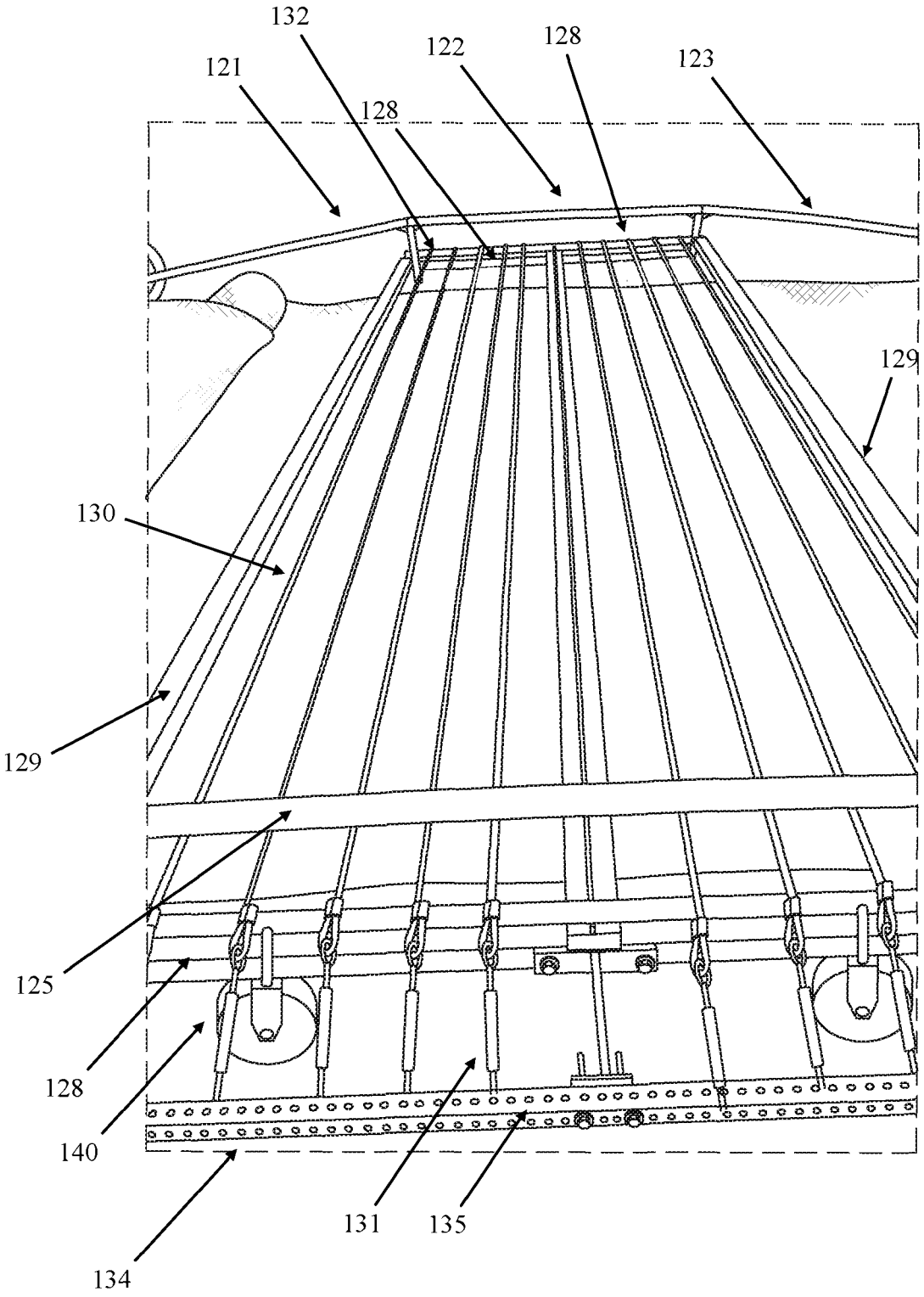
FIG. 7 is an illustration of a top perspective view of the comb of the synthetic turf infill removal device.
Figure 8:
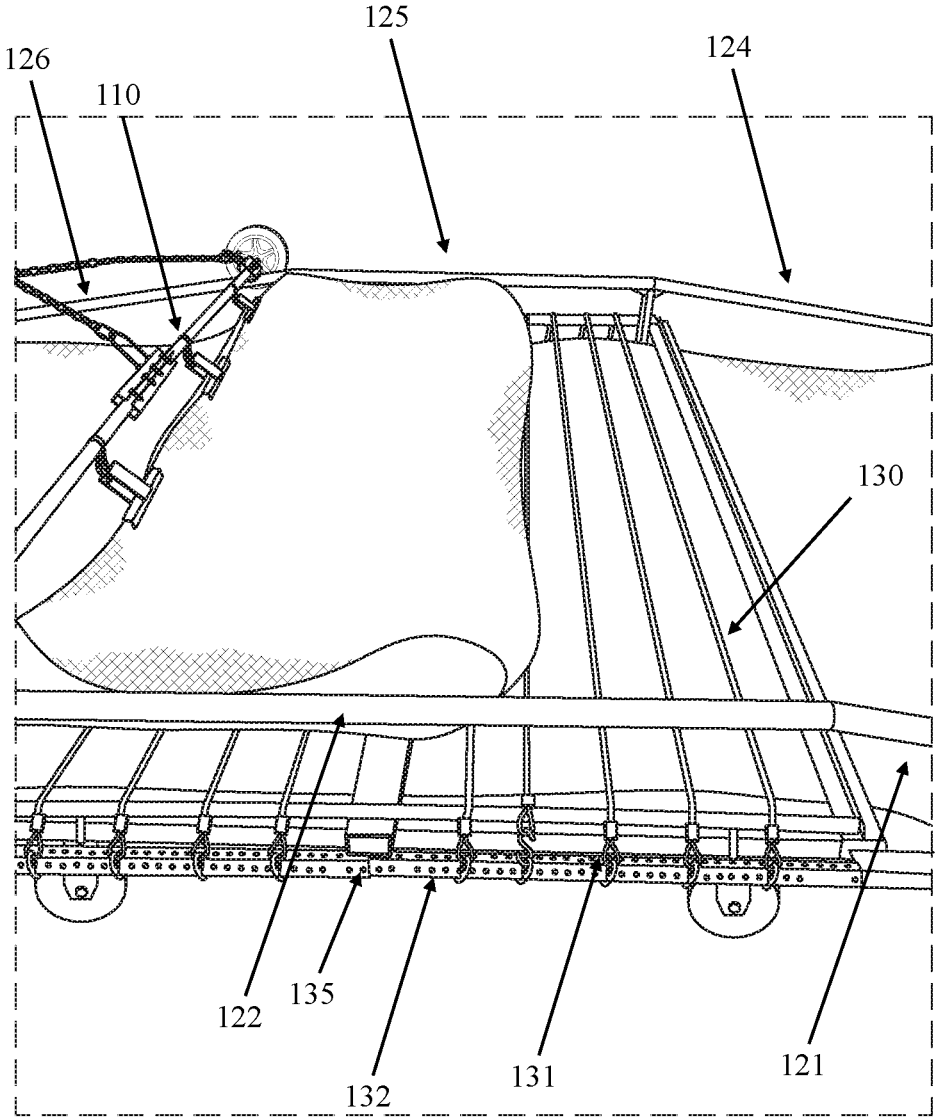
FIG. 8 is an illustration of the pull bar pulling an area of the synthetic turf over the comb.

With the ends of an area of synthetic turf 133 connected to pull bar 110 by one or more clamps 106, winch 102 may retract winch cable 104, pulling the ends over the rest of the area of the synthetic turf 133 thereby inverting the area of synthetic turf 133 while drawing pull bar 110 towards winch 102 over comb frame 120. Comb frame 120 is designed to dislodge or otherwise separate infill from the inverted area of synthetic turf 133 while guiding pull bar 110 over comb frame 120. Comb frame 120 may have a plurality of leg members in the form of elongated bars on the left support and right support side of comb frame 120 that together make up the support structure for which pull bar 110 passes over as illustrated in FIG. 7 and FIG. 8

The left support side of comb frame may include three elongated bars including an inclining first bar 121, a horizontal second bar 122, and a declining third bar 123 which may be directly or indirectly connected to one another. For example, inclining first bar 121 may be directly or indirectly connected at a terminal end to the terminal end of second bar 122, the opposite terminal end of second bar 122 may be connected directly or indirectly to a terminal end of third bar 123. In one or more non-limiting embodiments, joining members may couple the framework members of bars 121, 122, and 123.

Correspondingly and parallel to the left support side, on the opposite side of comb frame 120, the right support side of comb frame 120 may have three elongated bars including an inclining first bar 124, a horizontal second bar 125, and a declining third bar 126 which may directedly or indirectly be connected to one another. For example, inclining first bar 124 may be directly or indirectly connected at a terminal end to a terminal end of second bar 125, the opposite terminal end of second bar 125 may be connected directly or indirectly to a terminal end of third bar 126. In one or more non-limiting embodiments, joining members may couple the framework members of bars 124, 125, and 126

Comb frame 120 may be comprised of two or more vertical posts 128 which support a number of evenly or unevenly spaced agitating members 130 extending between vertical posts 128. Further, the comb frame 120, in one or more embodiments, may include two or more horizontal posts 129 extending between vertical posts 128, forming a rectangle between vertical posts 128. Comb frame 120 may have one or more wheels 140 connected to vertical posts 128 or components of comb frame 120 allowing comb frame 120 to be moved and positioned in a designated area.

In one or more non-limiting embodiments, comb frame 120 may support a number of agitating members 130 extending in a different direction from the directions shown for agitating members 130 in the illustrations, such as at a right angle, acute angle, or obtuse angle. In other non-limiting embodiments, there may be intermediate vertical posts 128 and horizontal posts 129 that operate as a pass-through post whereby agitating members 130 pass through a hole in one or more intermediate vertical posts 128 or horizontal posts 129.

In one or more non-limiting embodiments, agitating member fasteners 131 receive agitating members 130 and affix agitating members 130 to left and right base members 132 and 134 whereby in a preferred embodiment a portion of agitating members 130 rest upon vertical members 128 with an area of agitating members 130 extending past vertical members 128 and connecting to agitating member fasteners 131.

The end of agitating members 130 may pass through a hook on agitating member fasteners 131 and be folded over onto their self so as to form a loop through the hook on agitating member fasteners 131. The loops may be secured by a crimped or hog ring. Agitating members 130 may be connected to the agitating member fasteners 131 by passing the throat of the hook through the loop whereby the point of the hook extends outside the loop to restrain longitudinal movement of the agitating members 130 with respect to the vertical members 128.

In one or more non-limiting embodiments, left and right base frame members 132 and 134 may have one or more fastenings holes 135 formed through left base member 132 and right base frame member 134 whereby fastening holes 135 of a certain distance from one another on left base member 132 align with corresponding fastening holes 135 on right base member 134 and a position-locking pin may be placed to lock agitating members fasteners 131 at a specific position in relation to left and right base frame members 132 and 134. In one or more non-limiting embodiments, the position-locking pin may be an instrument entered into fastening holes 135 through the left and right base frame members 132 and 134 and secured providing stability to agitating members 130 during operation. In other non-limiting embodiments, winch 102 may be mounted to the side of a vehicle in a conventional manner and in any of several possible positions. Left and Right base members 132 and 134 may be positioned on either side of a truck bed whereby comb frame 120 may be positioned over the truck bed or another collection apparatus on the vehicle such that infill may be deposited into the truck bed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A system for separating the infill from an area of synthetic turf:

a first winch having a first cable, the first cable configured to be extended and retracted from the first winch;

a comb frame, the comb frame positioned rearward from the first winch; and a pull bar, the pull bar positioned initially rearward from the comb frame, the pull bar configured to move over the comb frame, the pull bar removably connected to the first cable, the pull bar having one or more fasteners removably connected to an end of the area of synthetic turf;

wherein the comb frame has one or more agitating members configured to separate the infill from the area of synthetic turf when the first cable is retracted forward to the winch and the area of synthetic turf is pulled over the comb frame in an inverted position.

2. The system of claim 1, the pull bar having a first wheel and a second wheel, the first wheel and the second wheel configured to rotate upon retraction of the first cable from the first winch.

3. The system of claim 2, the first winch having one or more chains removably connected to the first winch, the one or more chains each removably connected to a fastener, the fastener configured to couple the one or more chains to a surface to stabilize the first winch during operation.

4. The system of claim 2, wherein the fasteners of the pull bar are one or more clamps, the one or more clamps removably holding the area of synthetic turf clamped between a top clamp component and a bottom clamp component.

5. The system of claim 4, wherein the position of clamps on the pull bar are adjustable for different widths of the area of synthetic turf.

6. The system of claim 2, a second winch having a second cable configured to be extended and retracted, the pull bar removably connected to the second cable wherein the second cable is configured to retract and pull the area of synthetic turf back over the comb frame to enable bidirectional cleaning of the synthetic turf.

7. The system of claim 2, the comb frame having a plurality of leg members on the left and right sides of the comb frame making up the support structure of the comb frame for which the pull bar passes over.

8. The system of claim 7, wherein the plurality of leg members are elongated bars including an inclining first bar, a horizontal second bar, and a declining third bar, the first bar connected at a terminal end to a terminal end of the second bar, an opposite terminal end of the second bar connected to a terminal end of the third bar.

9. The system of claim 8, the comb frame comprised of two or more vertical posts which support the agitating members, the agitating members extending between the vertical posts, the comb frame comprised of two or more horizontal posts extending between the two or more vertical posts.

10. The system of claim 9, further comprising one or more comb fasteners, the comb fasteners configured to receive the agitating members and affix the agitating members to a first and second base member.

11. The system of claim 10, further comprising comb fasteners, the agitating members resting upon vertical members, a portion of the agitating members extending past the vertical members wherein the portion extending past the vertical members is connected to the comb fasteners.

12. The system of claim 11, the ends of the agitating members folded over onto their self so as to form a loop through which a hook on the comb fasteners pass through, the loops secured by a ring, the loop configured to receive the hook wherein the hook restrains longitudinal movement of the agitating members with respect to the vertical members.

13. The system of claim 12, the first and the second base frame members having one or more fastening holes formed through the first and the second base frame members, the fastening holes of a certain distance from one another wherein the fastening holes through the first base member align with corresponding fastening holes on the second base member.

14. The system of claim 13, further comprising position-locking pins configured to lock the comb fasteners at a specific position in relation to the first and the second frame members.

15. The system of claim 1, the first winch having one or more solar collectors, the one or more solar collectors configured to convert solar energy to electric energy, the first winch having a battery configured to receive and store the electric energy.

16. A method of separating infill from an area of synthetic turf, the method comprising:

extending a first cable from a first winch rearward to be moved over a comb frame and to extend rearward therefrom;

connecting the first cable to a pull bar, the pull bar positioned rearward from the comb frame;

removably placing one or more first fasteners on the pull bar to a first end of the area of synthetic turf, the pull bar having one or more wheels;

retracting the first cable from the first winch forward to be pulled over the comb frame, the area of synthetic turf inverting when pulled over the comb frame; and separating the infill from the area of synthetic turf by one or more agitating members on the comb frame.

17. The method of claim 16 further comprising:

extending a first chain from the first winch, the first chain positioned on the rear of the first winch; and connecting a fastener to the first chain, the fastener coupling the first chain to a surface to provide stability to the first winch.

18. The method of claim 17 further comprising:

extending a second cable from a second winch, the second winch positioned on the opposite side of the comb frame; and connecting the second cable to the pull bar.

19. The method of claim 18 further comprising, removably connecting one or more second fasteners on the pull bar to a second end of the area of synthetic turf;

retracting the second cable from the second winch pulling the area of synthetic turf back over the comb frame, and separating the infill from the area of synthetic turf by the one or more agitating members on the comb frame.

* * * * *